US009174704B1

(12) United States Patent
Crawford

(10) Patent No.: US 9,174,704 B1
(45) Date of Patent: Nov. 3, 2015

(54) INTERACTIVE WATER SHIELD FOR RAFTS OR BOATS IN WATER RIDES

(71) Applicant: DISNEY ENTERPRISES, INC., Burbank, CA (US)

(72) Inventor: David W. Crawford, Long Beach, CA (US)

(73) Assignee: DISNEY ENTERPRISES, INC., Burbank, CA (US)

( * ) Notice: Subject to any disclaimer, the term of this patent is extended or adjusted under 35 U.S.C. 154(b) by 20 days.

(21) Appl. No.: 14/310,126

(22) Filed: Jun. 20, 2014

(51) Int. Cl.
*B63B 17/00* (2006.01)

(52) U.S. Cl.
CPC ..... *B63B 17/00* (2013.01); *B63B 2017/009* (2013.01)

(58) Field of Classification Search
USPC ..... 114/361
IPC ..... B63B 19/02,17/00, 2017/009
See application file for complete search history.

(56) References Cited

U.S. PATENT DOCUMENTS

| | | | | |
|---|---|---|---|---|
| 2,058,383 | A | 10/1936 | Maynes | |
| 3,906,563 | A * | 9/1975 | Bramhall | B63B 19/02 114/361 |
| 4,273,060 | A | 6/1981 | Pavincic | |
| 4,367,689 | A | 1/1983 | Lukehart et al. | |
| 4,516,943 | A | 5/1985 | Spieldiener et al. | |
| 4,696,251 | A | 9/1987 | Spieldiener et al. | |
| 5,299,964 | A | 4/1994 | Hopkins | |
| 5,331,914 | A | 7/1994 | Salmons | |
| 5,421,284 | A | 6/1995 | Wardavoir | |
| 5,613,443 | A | 3/1997 | Ariga et al. | |
| 5,947,052 | A | 9/1999 | Deising | |
| 5,989,126 | A | 11/1999 | Kilbert et al. | |
| 6,006,490 | A | 12/1999 | Thibeault | |
| 7,144,061 | B1 | 12/2006 | Behm et al. | |
| 7,182,038 | B2 | 2/2007 | Dougherty | |
| 7,204,198 | B2 * | 4/2007 | Anderson | B63B 29/04 114/343 |
| 7,415,938 | B2 | 8/2008 | Duffield | |
| 7,854,663 | B2 | 12/2010 | Burger | |
| 8,475,288 | B2 | 7/2013 | Raymond et al. | |

FOREIGN PATENT DOCUMENTS

WO 2013125770 A1 8/2013

OTHER PUBLICATIONS

Hopkins, "Spinning Rapids Ride," Spinning Rapids Ride, Image Gallery, www.hopkinsrides.com/public/spinning%20ride/index.cfm, Mar. 26, 2014.

* cited by examiner

*Primary Examiner* — Stephen Avila
(74) *Attorney, Agent, or Firm* — Marsh Fischmann & Breyfogle LLP; Kent A. Lembke

(57) ABSTRACT

A passenger boat configured for interactively shielding passengers from incoming water. The boat includes a hull with seats for receiving passengers and a rider interactive assembly with an input element for receiving input from the passengers. The boat also includes a water shield supported on the hull and an actuation system operating in response to the input from the passengers to move the water shield from a first position to a second position relative to the seats. In some cases, the water shield is mounted on the hull to travel within a channel extending about a perimeter of the hull located on an outboard side of the seats. Then, the water shield may include a wall that extends substantially vertically from the channel.

26 Claims, 10 Drawing Sheets

INTERACTIVE WATER SHIELD FOR RAFTS OR BOATS IN WATER RIDES

BACKGROUND

1. Field of the Description

The present description relates, in general, to passenger boats such as round rafts and their use in water-based rides (e.g. "raft rides") in amusement parks, theme parks, and water parks, and, more particularly, to a passenger boat with a passenger-controllable or positionable shield or bather to selectively block water from entering the boat or spraying its passengers.

2. Relevant Background

In amusement parks, water parks, resorts, and many other settings, entertainment is provided that involves passengers riding on boats in still and moving water. For example, resorts may provide passenger boats in the form of rafts, kayaks, and paddleboats to their guests to allow them to play in the water. In amusement parks, many rides have been designed and implemented that provide a river rafting experience that may simulate whitewater rafting. Passengers typically enter a boat such as a round raft in a station, and water flowing in a channel moves the passenger boats down the channel and may even cause the boat to flow over rapids and down steep chutes.

Excitement and thrill is added to this water entertainment including water rides by introducing the risk that passengers may get soaked with water or at least be sprayed. For example, the raft filled with passengers may float down a winding river and a waterfall may drop water into a portion of the boat. Passengers may also get splashed or wet during the normal operation of the boat floating through turbulent water or at the bottom of ramps. In other cases, devices may be positioned on differing sides of the channel (e.g., a "lazy river") that randomly or intermittently spray jets of water out into the channel where a boat may be traveling. In still another example, spectators along a body of water may be provided large squirt guns or water cannons that they can operate to shoot water out into the body of water at people in nearby boats to try to soak their "friends."

In such water-based entertainment (generally, called "water rides" herein), the passengers typically have little or no control over whether or not they get wet. In the waterfall example, the movement of the boat or raft is typically random, and the passenger has to rely on luck or chance to see whether their seat or part of the boat or raft is the one that passes under the waterfall. There are presently only very limited opportunities for passenger interactivity in water rides, and such opportunities typically have been limited to providing the passengers (or spectators) with squirt guns that they can operate to squirt passengers in other boats.

SUMMARY

The inventor recognized that there was a need for a water ride that provided passengers of boats, rafts, and the like (with all such watercraft labeled as "a passenger boat" herein) options for increased interactivity. For example, there was a need for passengers to be able to decide whether or not they wanted to get wet. It was also determined by the inventor that it would be exciting for people in a passenger boat to be able to work together or to collaborate to make such decisions and to be able operate their passenger boat in a defensive manner, e.g., to defend all or some of the passengers against an upcoming water attack (such as jets of water originating along one bank or side of a river ride's channel, a waterfall, and the like that the passengers see that their boat is approaching). In the past, water-based interactivity in water rides had been offensive including squirting other ride participants, but the passenger boats of the present description include features that allow the passengers to interact with the boat and each other in a defensive manner to control how much if any water enters the passenger boat.

Briefly, a passenger boat (or passenger-carrying boat) is provided that includes a water shield assembly mounted on or supported upon the boat hull. The water shield assembly includes a shield or barrier that is supported such that it can be selectively positioned at numerous locations about the hull's perimeter. For example, the shield or barrier may be supported within a track or guide channel on an upper side of the boat hull, with the track or guide channel being positioned between the passenger seats/supports and an outer edge or side of the boat hull so as to allow the shield or bather to be placed between the passenger seats and a body of water supporting the boat. The water shield assembly also includes an actuation system for moving the shield or barrier along or within its support track or guide channel, and a passenger (or rider) interactive assembly (or device) is provided to allow the passengers to provide input that selectively controls or operates the actuation system to move the water shield to new positions in the support track or guide channel (or, in some implementations, to rotate the water shield about the center axis of the passenger boat).

By including a rotatable (or user-positionable) shield element in a passenger boat, riders (or passengers) can attempt to protect themselves from getting wet during the course of the water ride. They can act as a team by their collaborative or concurrent use of the passenger interactive assembly or they can act selfishly in their use of the passenger interactive assembly to strategically position the water shield and protect a limited area of the boat. In other words, the water shield is configured to only protect a fraction of the perimeter of the boat hull such as one half to one fourth (or less) of the hull perimeter such that its careful positioning is needed to protect all or only a subset of the passenger seats (and the passengers in those protected seats) from water.

In some cases, the shield is a vertical or an angled (45 to 90 degrees or the like) wall or panel, which may be formed of solid plastic or similar material or may contain holes or gaps to add to the excitement by not blocking all the incoming water and by retaining some random water soaking features in the water ride (e.g., tried to protect everyone but some still got wet). In other cases, the shield may include a wall (vertical or slanted) along with a roof or horizontal portion that extends outward from an upper portion of the wall to protect the boat interior volume including the passenger seats from water falling downward into the boat. The water "attacking" or coming into the boat interior may take the form of splashes or waves occurring during the boat ride or in quick drops in elevation, water from water cannons provided as part of the water ride, and/or water gun spray from other boats or from non-passengers (e.g., spectators or people in a water ride queue).

More particularly, a passenger boat is provided that is configured for interactively shielding passengers from incoming water. The boat (e.g., nearly any floating vehicle such as a round raft) includes a hull with seats for receiving passengers and a rider interactive assembly with an input element for receiving input from the passengers. The boat also includes a water shield supported on the hull and an actuation system operating in response to the input from the passengers to move the water shield from a first position to a second position relative to the seats.

In some cases, the water shield is mounted on the hull to travel within a channel extending about a perimeter of the hull located on an outboard side of the seats. Then, the water shield may include a wall that extends substantially vertically from the channel. Further, the shield may include a roof element extending outward from an upper end of the wall toward a center axis of the hull. In some cases, the wall has a solid body for blocking all water while other implementations may provide a wall that has at least one gap or hole through which water may pass to the passengers.

The rider interactive assembly may include a support arm linked to the input element to rotate about an axis in response to movement of the input element, and, in such cases, the actuation system responds to rotation of the support arm to move the water shield between the first and second positions. In one embodiment, the actuation system includes a connecting arm rigidly coupled at a first end to the support arm and at a second end to a slewing ring configured for rotating about a center axis of the hull. In such an embodiment, the shield is supported upon the slewing ring to move with the slewing ring. In another embodiment, the actuation system includes a connecting drive belt or chain mating with an outer surface of the support arm to move with the rotation of the support arm and further mating with a drive shaft of a friction wheel such that the friction wheel rotates with movement of the drive belt or chain. In this embodiment, the actuation system further includes a slewing ring supporting the water shield and having a running surface mating with the friction wheel, whereby the slewing ring rotates about a center axis of the hull in response to rotation of the friction wheel.

In other embodiments, the input element transmits electrical signals in response to the received input. The rider interactive assembly may then further include a controller processing the electrical signals from the input element and in response transmitting shield movement control signals. To achieve shield movement, the actuation system may include an electric motor operating to drive movement of the shield from the first position to the second position in response to the shield movement control signals. The electrical signals from the input elements can be processed by the controller to determine both a direction of movement of the shield on the hull and a rate of the movement of the shield by the electric motor.

DETAILED DESCRIPTION OF THE PREFERRED EMBODIMENTS

Briefly, the following description describes passenger boats (which should be construed broadly to include nearly any floating structure such as a raft, a round boat, and the like with passenger seats/supports) that are adapted to allow the passengers or riders to protect themselves from incoming water or to select which of them gets soaked during the water ride (which should be construed broadly to mean nearly any type of water-based entertainment). Each of the passenger boats is adapted to create a new and fun interactive device for the riders to operate during the course of the ride to selectively rotate or position a water shield or barrier such as through operation of a shield-movement actuation system interconnected with the interactive assembly to be responsive to rider/passenger input. The challenge of properly positioning the water shield in a defensive manner can be increased or enhanced by the natural spinning of the passenger boat since the water shield may need to be continuously repositioned as the boat spins and also as new sources of incoming water are identified along the ride's path (e.g., along a water channel containing flowing water).

The following description teaches a passenger boat configured to provide the passengers (or riders) with an interactive water shield. The passenger boat includes a hull (or body), which can float in water, that has seats or other supports to receive passengers, and, in a typical use such as a water ride, the hull moves through a fixed path channel of water. The passenger boat also includes a shield or barrier that is attached to the floating hull, and the shield or bather is attached or supported upon the hull so as to be able to move along the perimeter of the hull (such as in a guide channel/support track between the passenger supports/seats and an outer edge/side of the hull's side wall). The passenger boat also includes an interface device that can be operated by the boat passengers to move the shield.

In some implementations of the passenger boat, the water shield or barrier is pivotally attached at the center of the boat's hull (or body) and can be rotated by the passengers about the center axis of the hull through use of the interactive device (which drives or controls operation of an actuation system). The interactive device may be a mechanical assembly directly connected to the water shield or barrier that is operable by the passengers in the passenger seats/supports. The interactive device may take other forms, too, such as an input mechanism (e.g., a button, a joystick, or the like) that operates an electric motor or actuator in the actuation system that moves the water shield in its support track or guide channel from a first (or current) position to a second (or new) position (e.g., a new position that may protect one or more of the passengers in their seats from getting sprayed with water).

Figure 1:
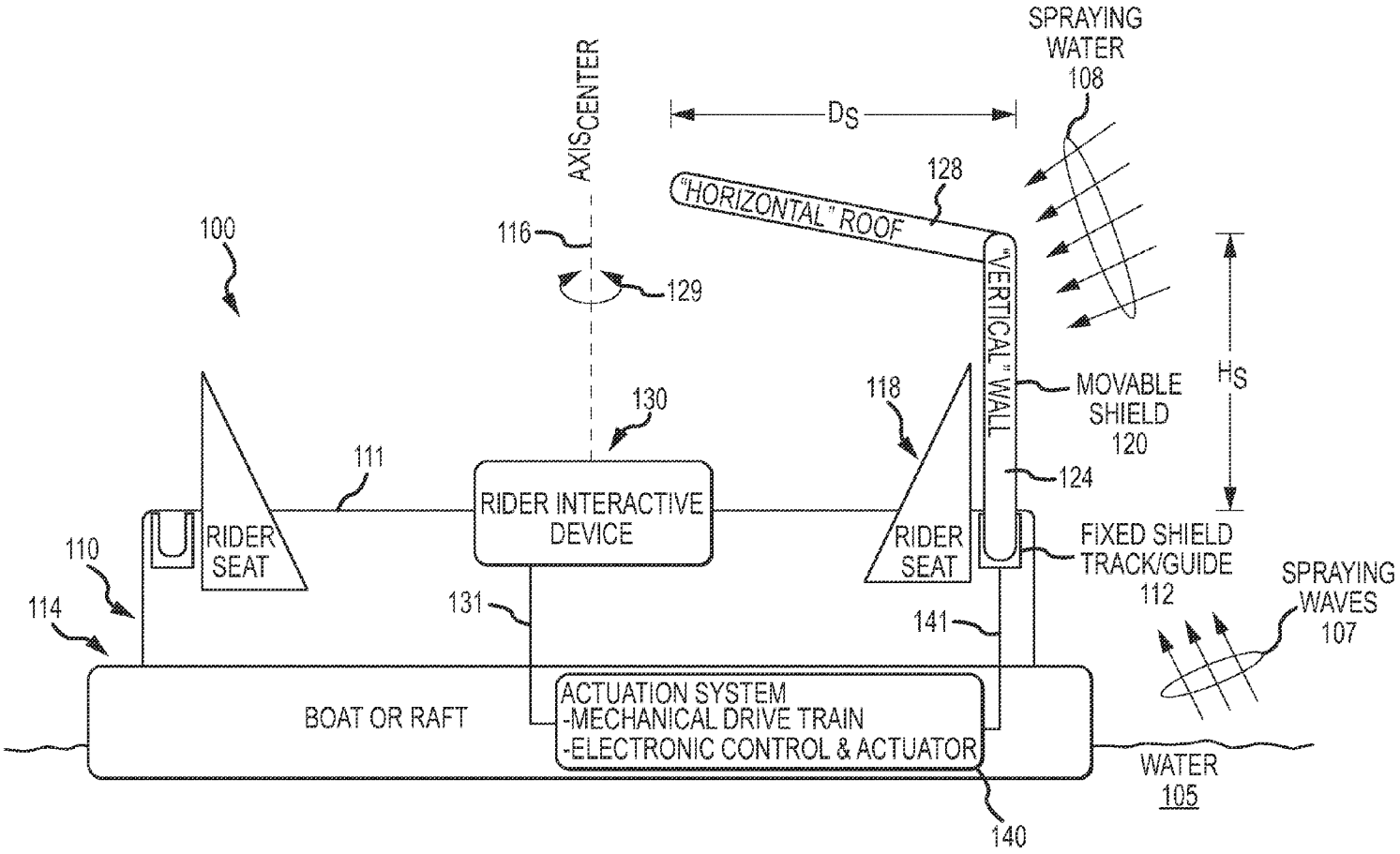
FIG. 1 is a functional block diagram of a passenger boat of the present description during its use (e.g., positioning of a rider-movable shield) in a water ride to defend or protect the riders in the boat from splashing or spraying water.

FIG. 1 is a functional block diagram of a passenger boat 100 of the present description shown during its use (e.g., positioning of a rider-movable shield) in a body of water or a channel of water 105 in a water ride to defend or protect the riders in the boat from splashing or spraying water 107, 108. For example, the water 107 may be from the body of water 105 in the form of waves and rapids that splash into the boat 100 while spraying or shooting streams of water 108 may be from water cannons or similar ride effect devices or from squirt guns or other sources such as a waterfall (which may come downward into the boat 100 or from the side).

As shown, the passenger boat 100 includes a flotation portion or element 114 such as an inflated rubber bladder, one or more pontoons, or the like upon which a hull 110 is supported, but some embodiments may simply have a hull without additional flotation-enhancing components. The hull 110 may include sidewalls with an upper surface or top edge 111, and the hull 110 may define an interior space or seating space for passengers. The passenger boat 100 may include one, two, or more passenger seats (e.g., any type of support for people to sit or rest in the boat hull 110) 118. As the boat 100 moves in the water 105, it may spin about its center axis 116, which can make it difficult to protect the interior space of the hull 110 with seats 118 from the spraying water 107, 108 without totally enclosing the space (which is generally undesirable in a water ride where the risk of being drenched is a large part of the appeal of the rides to passengers or riders of the boat 100).

To allow the passengers in the seats 118 to elect to block the water 107, 108, the passenger boat 100 includes a movable shield or bather 120. The movable shield 120 is shown to include a vertical wall 124 that is supported to be able to ride or slide within a shield track or guide 112, which may be fixed (or stationary) and provided with the hull 110 or a sidewall of the hull 110, and the track 112 may extend along a portion of the perimeter of the hull 110 or, more typically, along the entire perimeter of the hull 110 to facilitate positioning of the shield 120 at any location along the hull's perimeter. The vertical wall 124 extends outward and upward from the hull upper surface or edge 111 to a desired height, $H_S$, such as 2 to 6 feet or the like with the specific height, $H_S$, chosen to suit the design of the seats 118 and the expected water "hazards" 107, 108 (e.g., coming from below 107 or from higher locations 108). The wall 120 may be wholly vertical (orthogonal to a horizontal plane) or be angled such as in the range of 45 to −45 degrees relative to a vertical plane.

The movable shield 120 further includes, in this embodiment, a horizontal roof or extension 128 that extends outward from a top end of the wall 124 toward the center axis 116 of the passenger boat 100. The roof or extension 128 is useful for blocking water that drops downward toward the seats 118 such as from sources above the top edge 111, e.g., from a waterfall, a higher mounted water cannon, or the like. The roof 128 may extend outward to a depth, $D_S$, in the range of 1 to 6 feet or the like (e.g., to a distance matching or somewhat less than the radius of the hull 110). The roof 128 may be horizontal (i.e., parallel to a horizontal plane) or be off of horizontal by some amount such as 0 to 60 degrees from a horizontal plane (e.g., to drain water away from the interior space of the hull 110 and seats 118 and any passengers therein). The wall 124 may be formed of a translucent to transparent plastic or other durable, water-resistant material (e.g., a sheet that may be planar or arched and that is 0.25 to 1 inches or the like thick).

The wall 124 may have a shape and width chosen to block a desired amount of water 107, 108. For example, the wall 120 may generally be a square or rectangular shape while other shapes may be chosen to suit the water ride theme or to add to the difficulty (or ease) of blocking water such as with a triangular or semi-circular shape. The width defines the percentage of the perimeter of the hull 110 that the wall extends along, and it may be desirable for the wall 124 to have a width that is less than about one half the hull perimeter (e.g., as measured along top edge or surface 111) so that the riders are forced or encouraged to continuously move the shield 120 to better block the water 107, 108 as the location of the sources of water 107, 108 varies along a water ride path or course and as the boat 100 spins about its central axis 116.

With this desired challenge to riders in mind, some implementations will provide a wall 124 that has a width of less than one third or even less than one fourth of the hull perimeter (e.g., a width of 3 to 8 feet or the like) to only allow blocking water 107, 108 from entering from a particular direction at a time (e.g., protect two to four or more of the seats 118 at any time with shield 120). The roof 128 may also be chosen to be rectangular in shape. In some cases, though, the roof 128 will have other shapes such as a triangular shape with its base at along the upper edge of wall 124. The wall 124 and roof 128 may have solid bodies to block all water 107, 108 striking its surfaces, but, in some embodiments, holes or gaps may be selectively cut through areas of the wall 124 and/or roof 128 to allow some water 107, 108 to pass through these defensive/protective devices. In such embodiments, excitement is provided because even with good placement of the shield 120 relative to incoming water 107, 108, some riders may still get wet (or such a result may be intentional by moving the spray hole next to one rider's seat 118).

The passenger boat 100 is configured to provide passengers in the seats 118 with an interactive experience as they can choose to move the shield 120 from its present position in the track or guide 112 to many other positions. This movement can be seen with arrow 129, which is intended to show that the water shield 120 may be rotated about the boat's or hull's center axis 116 (or can be moved along the track/guide 112 which traces a path along the perimeter of the interior space of the hull 110 containing the seats 118). In other words, the shield 120 is user-positionable within the track/guide 112, which is disposed between the passenger seats 118 and an outer surface of the hull 110 (or the track 112 encircles the seats 118). To this end, the passenger boat 110 includes a rider interactive assembly or device 130 that is operable by the riders in the seats 118 to provide input to cause the movement 129 of the shield 120 (or that functions to receive user input and to process this input to generate/send control signals to cause such movement 129). The rider interactive device 130 may take many forms to practice the boat 100 such as a mechanical device, an electrical device, or a computer-based device (e.g., a touchscreen).

The passenger boat 100 further includes an actuation system 140 in communication (mechanical or electrical interconnection) as shown at 131 with the rider interactive device 130. In this way, input at the device 130 by riders/passengers can be translated, by the actuation system 140, into movements of the shield 120 via an interconnection 141 between the shield 112 and the actuation system 140. The actuation system 140 also may take many forms to provide these functions, e.g., provide movement of the shield 120 in track/guide 112 as shown with arrow 129 in response to user inputs at the rider interactive device 130. For example, the actuation system 140 may take the form of a mechanical drive train responsive to operation of the rider interactive device to reposition the shield 120. In other cases, though, the actuation system 140 takes the form of an electronic control and/or actuator responsive to inputs from device 130 via connection/communication lines 131 to move the shield 120.

Figure 2:
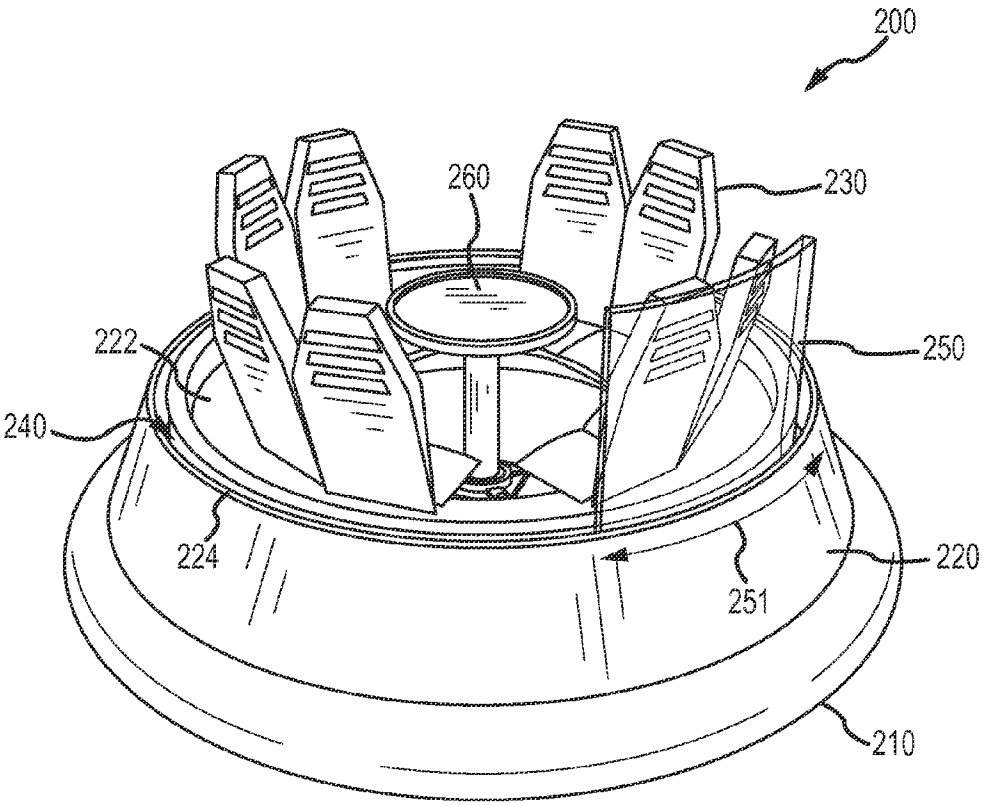
FIG. 2 is a top perspective view of a passenger boat (e.g., a round raft) for implementing the functionality shown in FIG. 1.

FIG. 2 illustrates a top perspective view of a passenger boat 200 that is adapted to allow its passengers to interact with the boat 200 so as to protect or defend themselves from water being sprayed or washing into the boat 200. The passenger boat 200 includes a flotation element 210 (e.g., an inflated rubber bladder, a pontoon(s), or the like), and a hull 220 is supported upon the flotation element 210 to enhance or allow the hull 220 to float when placed in a body of water (e.g., a river channel of a water ride).

The hull 220 is configured, e.g., with a circular or dish shaped sidewall, to define an interior volume or space with a floor or deck 222, and two or more seats (e.g., any useful passenger support devices) 230 are positioned and supported in the interior space of the hull 220. In this implementation of a round raft/boat 200, the seats 230 are all facing inward toward the center axis of the hull 220. As a result of this design, passengers (not shown) sitting in these seats 230 would be facing each other as is common for boats/rafts designed for water rides and such design lends itself to the collaborative or team-based interaction with the boat 200 in defensive shield maneuvers described herein.

Particularly, a passenger (or rider) interactive device (or assembly) 260 is positioned in the center of the hull 220 or its interior space, i.e., with a central axis of the hull 220 passing through portions of the interactive device 260. This arrangement allows passengers in the seats 230 to all be able to operate the interactive device 260 to provide their user input to enable placement of a water shield or barrier 250, and, in the embodiment shown in FIG. 2, one, two, or more of the passengers in seats 230 may concurrently (or sequentially) provide their input via the interactive device 260 to position or move the shield 250.

The interactive device 260 may be considered a "center wheel" interactive device with the upper wheel being adapted for rotation or turning by the passengers to move the shield 250. To this end, the interactive device can be connected to the shield 250 in a number of mechanical ways such as a direct connection arm or some type of belt, chain, or other connector member-based connection that allows the movement of the wheel of interactive device 260 to be translated into shield movement or rotation as shown with arrow 251 with, if desired, some mechanical advantage (e.g., to reduce the amount of turning of the wheel (or input element) of the interactive device 260 that is needed to achieve movement 251 of the shield 250).

As shown, the hull 220, such as in its circular sidewall, includes a guide channel or track 240 with an open upper end in a top edge or surface 224 of the hull 220. The track 240 and its opening is circular in shape and is shown to extend about the perimeter of the hull 220, e.g., to enclose or encircle the interior space of the hull 220 containing the seats 230. In other embodiments, though, the track 240 may only extend along a portion of the hull's perimeter. With input (e.g., turning) of the interactive device 260, passengers in the seats 230 can move 251 the shield within the guide channel (or along the track) 240 to any position they desire along the perimeter of the hull 220 to "defend" one or more of the seats 230 and passengers in these shielded seats 230.

The shield 250 is shown to be arcuate in shape to match the curvature of the track/guide channel 240, and the shield 250 is also shown to extend upward from the surface 224 of the hull 220 so as to be above the tops of the backs of the seats 230, but the shield 250 may have a smaller or a greater height to practice the boat 200 (e.g., the height may be chosen to suit expected relative locations of incoming water sources). Additionally, the shield 250 is shown to have a width ($W_S$ shown in FIG. 5) such that it shields about two seats at a time (e.g., has a width greater than the width of two seats 230 plus the space between such seats in hull 220), but, as with the shield height, the shield width may be smaller or greater to implement the boat 200 and the designer's goals (e.g., make it harder to achieve adequate water protection with a smaller width or make it easier to protect the passengers with a greater width of the shield 250). Also, the shield 250 is shown to have a solid body, but the body of the shield 250 may have gaps or holes to provide further challenges or excitement in properly placing 251 the shield 250 during its use in a water ride.

Figure 3:
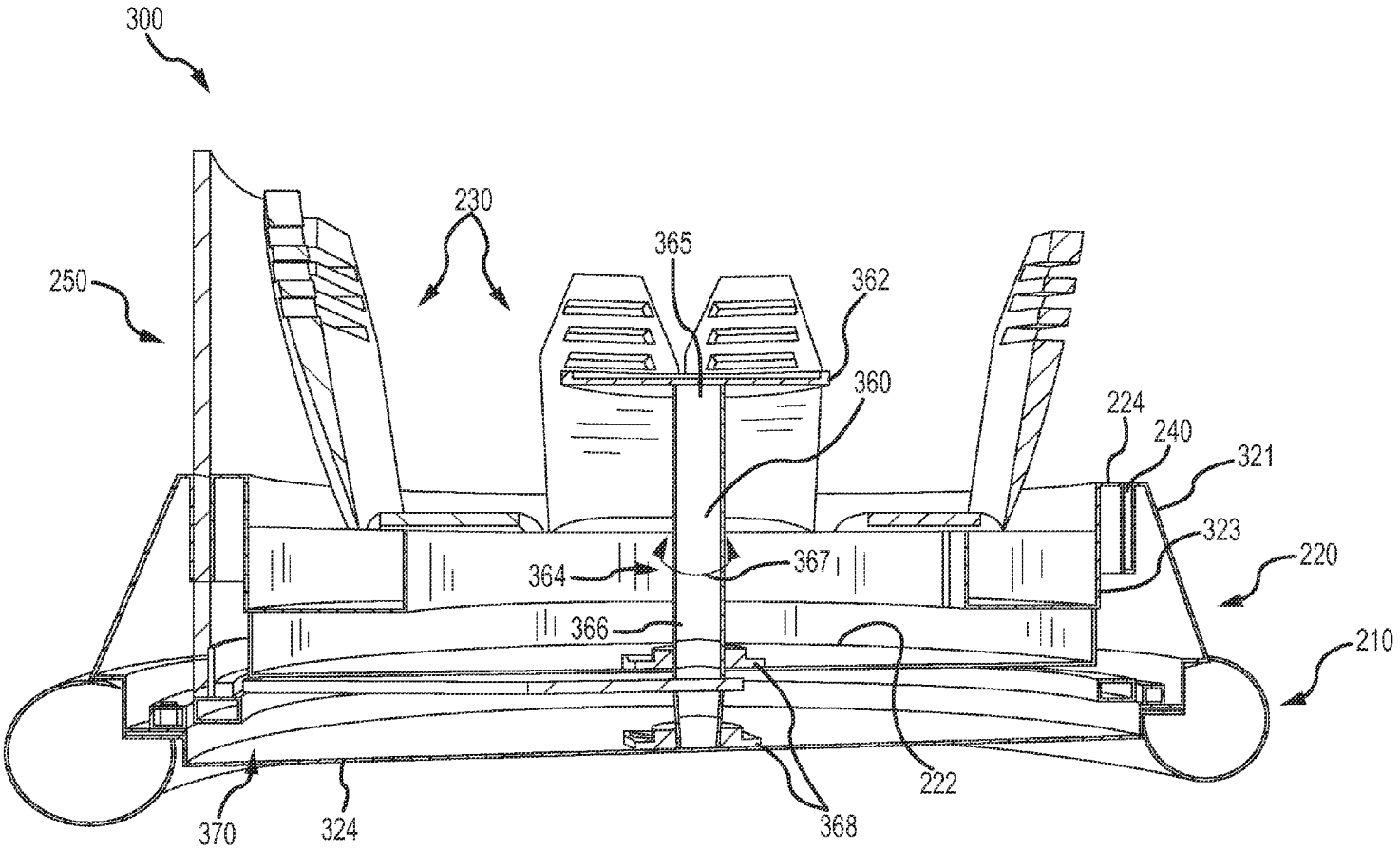
FIG. 3 is a side sectional view of an implementation of the passenger boat of FIG. 2 showing an exemplary rider interactive assembly or device and one useful actuation system for a water shield or barrier.
Figure 4:
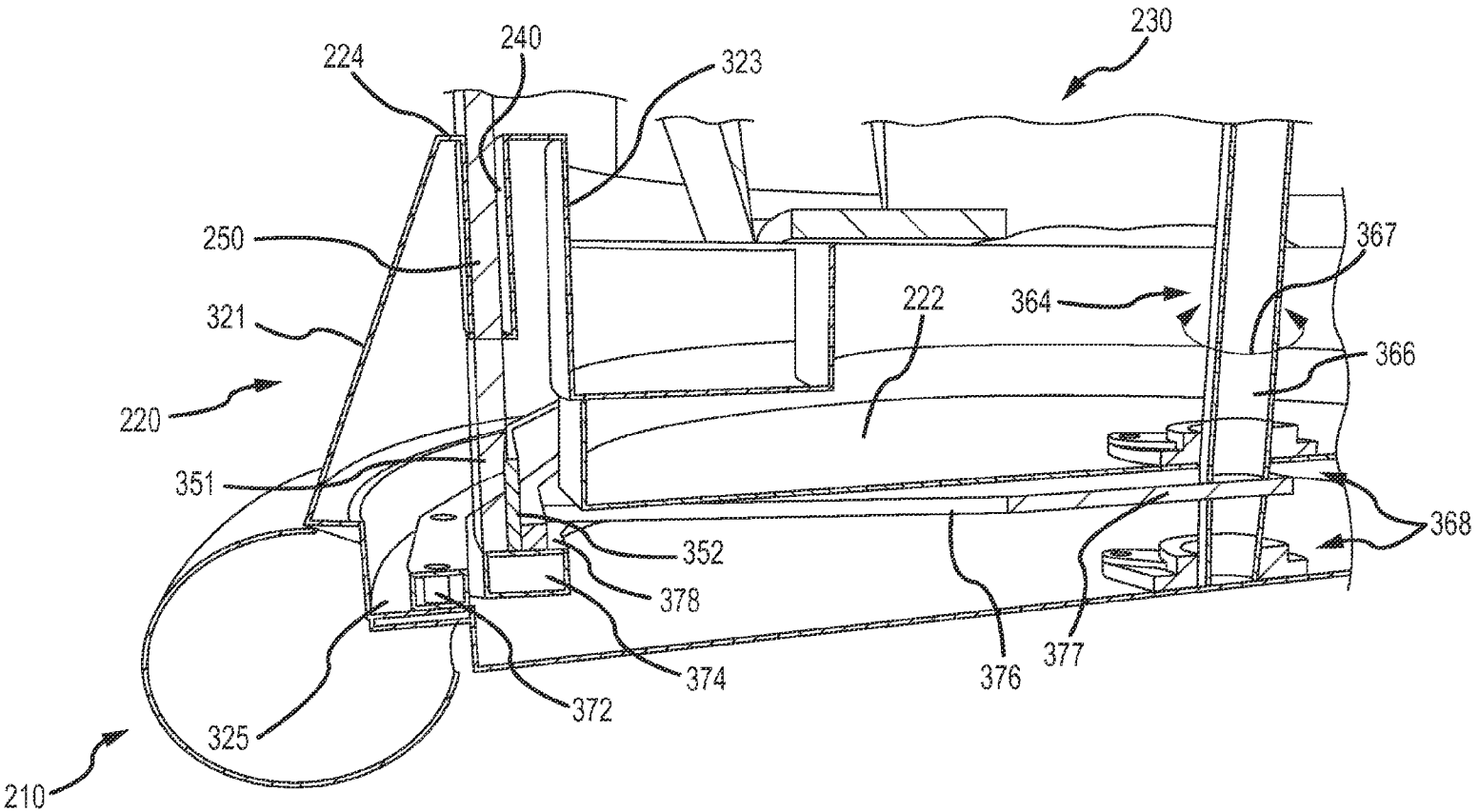
FIG. 4 is an enlarged view of the actuation system of the passenger boat of FIG. 3.
Figure 5:
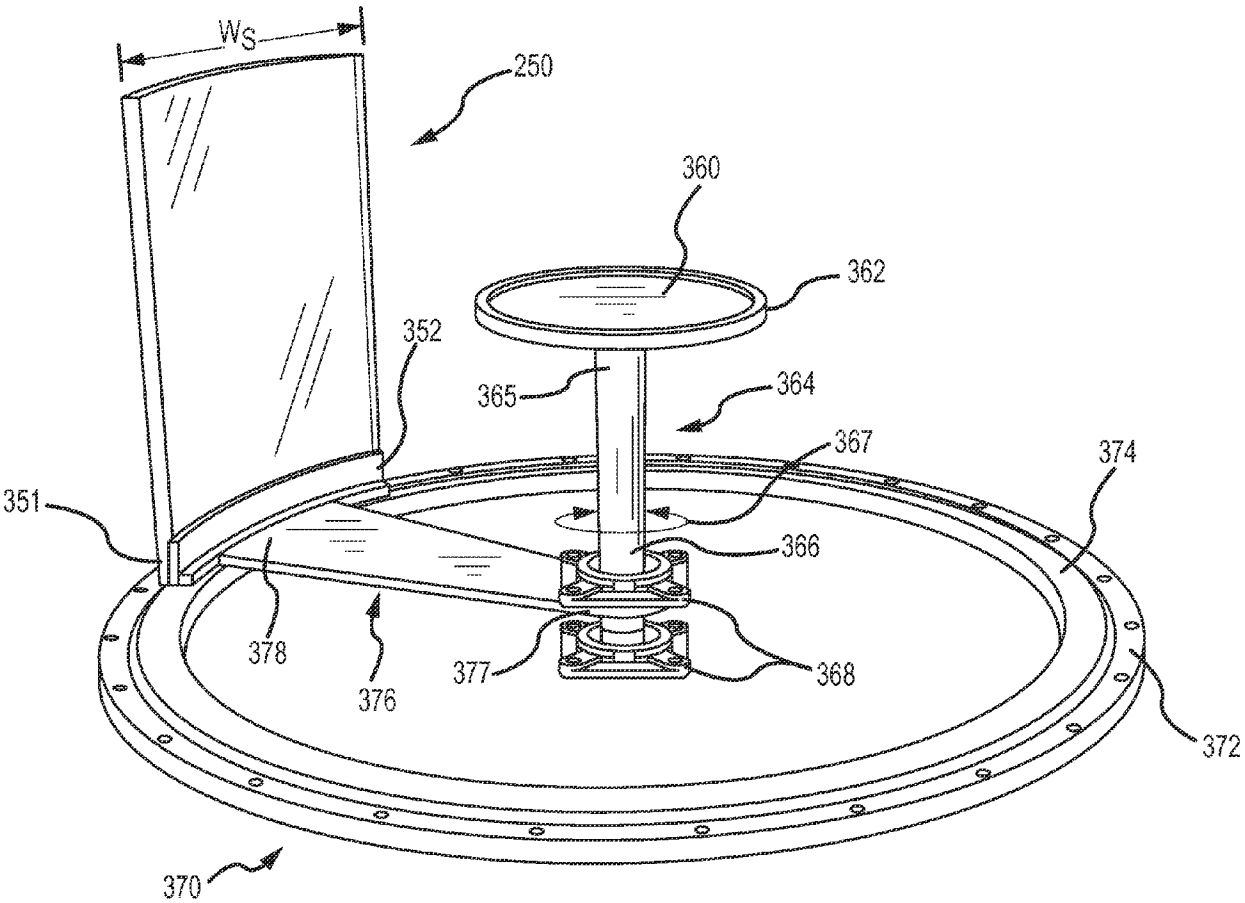
FIG. 5 is an exploded view of the passenger boat of FIGS. 3 and 4 with the hull, seats, and flotation components removed.

FIGS. 3-5 illustrates a passenger boat 300 showing particular implementations of the passenger interactive assembly 360 and the actuation system 370 for use in moving 251 the shield 250 in the track or channel 240. Note, elements shown in the boat 200 of FIG. 2 that are shown in later figures are given the same numbers and their description may not be repeated. The hull 220 has an outer hull (or sidewall) 321 and an inner hull (or sidewall) 323, and the track/channel 240 is provided between the outer and inner hulls 321, 323, with the inner hull defining the inner boat space for the passenger seats 230 and containing the base or deck 222.

As shown, the interactive assembly 360 has an input wheel 362 attached to a top end 365 of a vertically-arranged support arm (or column) 364. The wheel 362 may have a diameter and/or shape that makes it readily accessible or reachable by people in the seats 230, and, likewise, the height of the support arm 364 may be chosen to place the wheel 362 at an ergonomically desired location relative to passengers (of a variety of heights) in the seats 230. When the passengers turn (provide user input) the wheel 362, the rigidly coupled support arm 364 rotates as shown at 367. To this end, the support arm 364 is pivotally mounted to the hull 220 via a second or bottom end 366 and bearing mounts 368 affixed to the deck 222 and also to a lower base plate 324 provided below and spaced apart from the deck 222. The end 366 of the support arm 364 extends through the deck 222 such that a portion of this passenger-rotatable component of the assembly 360 is exposed in the space below the deck 222.

Within the space between the deck 222 and lower base plate 324, the passenger boat 300 includes the actuation system 370. The actuation system 370 is adapted to translate (with mechanical advantage) the rotation 367 of the support arm 364 of the interactive assembly 360 into movement of the shield 250 (e.g., rotation of the shield about the center axis of the hull 220 or along the perimeter of the hull 220 defined or following by the track/channel 240). To this end, the actuation system 370 includes a connecting arm 376 rigidly coupled or affixed at a first/inner end 377 to the end 366 of the support arm 364 (e.g., the exposed portion between the deck 222 and the lower base plate 324 and between bearing mounts 368). The connecting arm 376, hence, moves with the support arm 364 so as to spin about the center axis of the hull 220 in the illustrated embodiment of the boat 300 (e.g., like a hand of a watch). The connecting arm 376 may take the form of a rod or beam in some implementations or be a plate having a pie wedge (or partial pie wedge) shape as is shown with a first or inner end 377 having a smaller width than a second or outer end 378.

The second or outer end 378 of the connecting arm is rigidly coupled or attached to an inner slewing ring 374 of the actuation system 370. The slewing ring 374, hence, is rotated about the center axis of the hull 220 or boat 200 by movement of the connecting arm 376, which, in turn, is moved by rotation of the support arm 364 of the interactive device 360. To assist ease of movement and/or to support the slewing ring 374, the actuation system 370 further includes an outer slewing ring 372 mating with the inner slewing ring 374. The outer slewing ring 372 is fixed to the outer hull 321 on ring-support surface or ledge 324 extending about the periphery of the hull 320 as shown in FIG. 4. Generally, the slewing rings 372, 374 provide a very large bearing with an inner race and an outer race that are joined such as by a type of "0-friction" coupling (e.g., a plurality of roller bearings or the like).

Now, to move the shield 250, the shield 250 is supported upon the inner slewing ring 374. Particularly, a shield bracket 352 is affixed to an upper surface of the inner slewing ring 374, and a lower edge or side 351 of the shield 250 is received in and mated with the shield bracket to support the shield in its "vertical" position and to align its body with (within) the shield track or guide channel 240 in the hull 220. With this interconnection of components, the shield bracket 352 and the received shield 350 rotate about the center axis of the boat 300 or its hull 220 with movement of the inner slewing ring 374 on or against outer slewing ring 372 (which is fixed to the hull surface/ledge 325). The inner slewing ring 374 is driven to rotate by movement of the connecting arm 376, and the connecting arm 376 is rotated or positioned by pivoting or spinning the support arm 364 by riders or passengers moving or spinning the input wheel 362 of the rider interactive device 360. As shown, the shield 250 can be moved to any position about the perimeter of the boat hull 220 and be moved in either direction along the track or guide channel 240.

Figure 6:
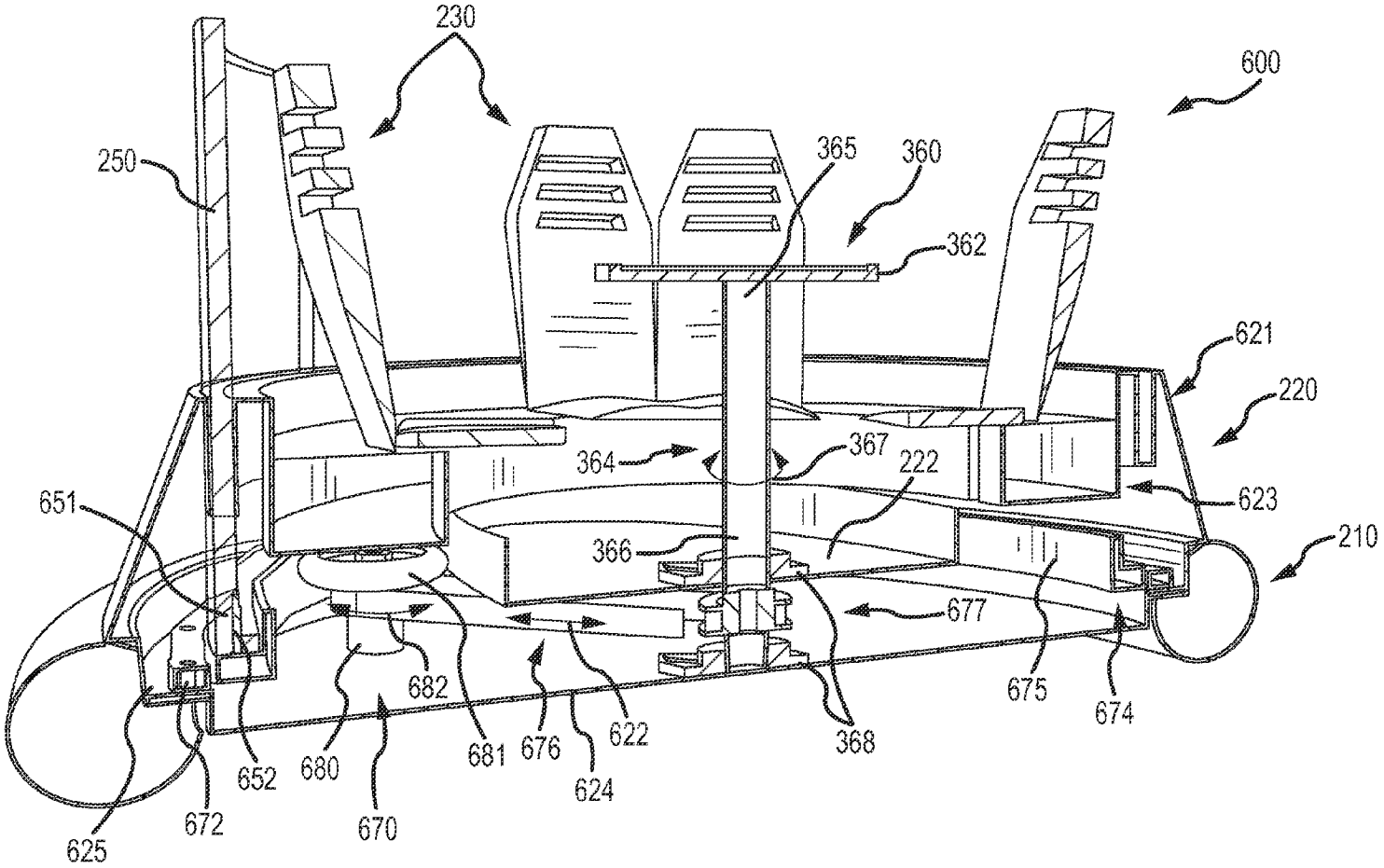
FIG. 6 is a side sectional view similar to that of FIG. 3 of a passenger boat with another actuation system of the present description.
Figure 7:
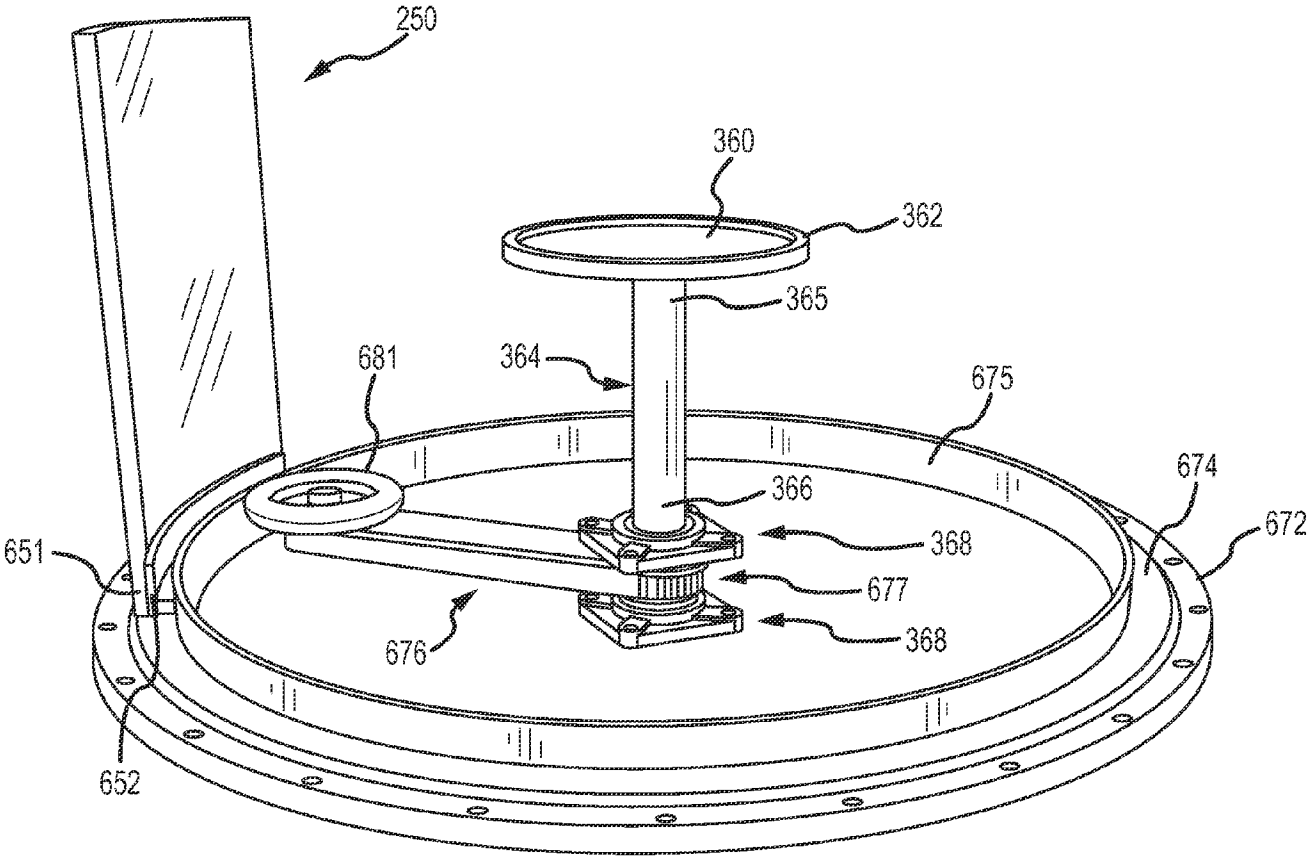
FIG. 7 is an exploded view of the passenger boat of FIG. 6 with the hull, seats, and flotation components removed.

FIGS. 6 and 7 illustrates another embodiment of a passenger boat 600 for providing an interactive water shield (or rider-positionable shield) 250. The passenger boat 600 has similarities with boats 200 and 300 including the flotation member 210, hull 220, passenger seats 230 in an interior space of the hull 220, and the water shield or barrier 250. Additionally, the passenger boat 600 makes use of the rider interactive assembly 360 with a similar configuration as shown for use in boat 300. The boat 600, though, includes a somewhat different outer hull 621 and inner hull 623 to define the track/channel 240 and to also provide space and supports for an actuation system 670 that differs from actuation system 370 to position the shield 250 in response to rider/passenger input via interactive wheel 362.

As shown, the actuation system 370 includes an outer slewing ring 672 affixed to an outer hull ledge or surface 625, and an inner slewing ring 674 is mated with the outer slewing ring 672 but allowed to freely move relative to the stationary outer slewing ring 672. The shield 250 has a lower end 651 received in and mated with a shield bracket 652 that is affixed to and supported upon the inner slewing ring 674 so that the bracket 652 and received shield 250 rotate about the center axis of the hull 220 with the inner slewing ring 674. These features are similar to the like components of the actuation system 370 of FIG. 3.

The actuation system 670 differs from the system 370, though, in how movements 367 of the support arm 364 of the interactive assembly 360 are translated into the movement or positioning of the shield 250 in the guide channel 240. Specifically, the actuation system 670 includes a flexible or non-rigid connecting member 676 that may take the four of a chain, belt, or the like rather than a rigid connecting member 376 as used in the system 370 of the boat 300. As shown, the connecting member 676 takes the form of a smooth or toothed drive belt that is driven by movement 367 of the support arm 364 via belt coupling element 677 (e.g., a toothed coupler when the inner surface of the drive belt 676 is also toothed) that is rigidly attached to the end 366 of the support arm 364. The attachment point for the belt coupling element 677 is in the space between the bearing mounts 368 and between the deck 222 and the lower base plate 624 of the hull 220. In this way, rotation 367 of the support arm 364 causes the belt/connecting member 676 to move linearly in one direction or back and forth as shown with arrow 677.

To translate these movements 367 and 677 into movement of the shield 250, the actuation system 670 includes a friction wheel 681 that is pivotally supported via a coupling element (not visible in the figures as covered by the belt 676) on a mount pedestal 680, which is affixed to the lower base plate 624 of the hull 220. The drive belt/connecting member 676 mates with a coupling element rigidly interconnected with the friction wheel 681 such that movement 677 of the belt/connecting member 676 causes the friction wheel 681 to rotate about its center axis as shown with arrow 682. The friction wheel 681 has its outer surfaces abutting or mating with a friction wheel running surface 675 extending (vertically in this case) from the inner slewing ring 676. In this way, the inner slewing ring 676 is causes caused to rotate about the center axis of the hull 220 or boat 600 when the friction wheel 681 is rotated by movement 677 of the drive belt/connecting member 676, which is driven by rotation 367 of the support arm 364 of the rider interactive device 360 that is provided by riders spinning input wheel 362.

Figure 8:
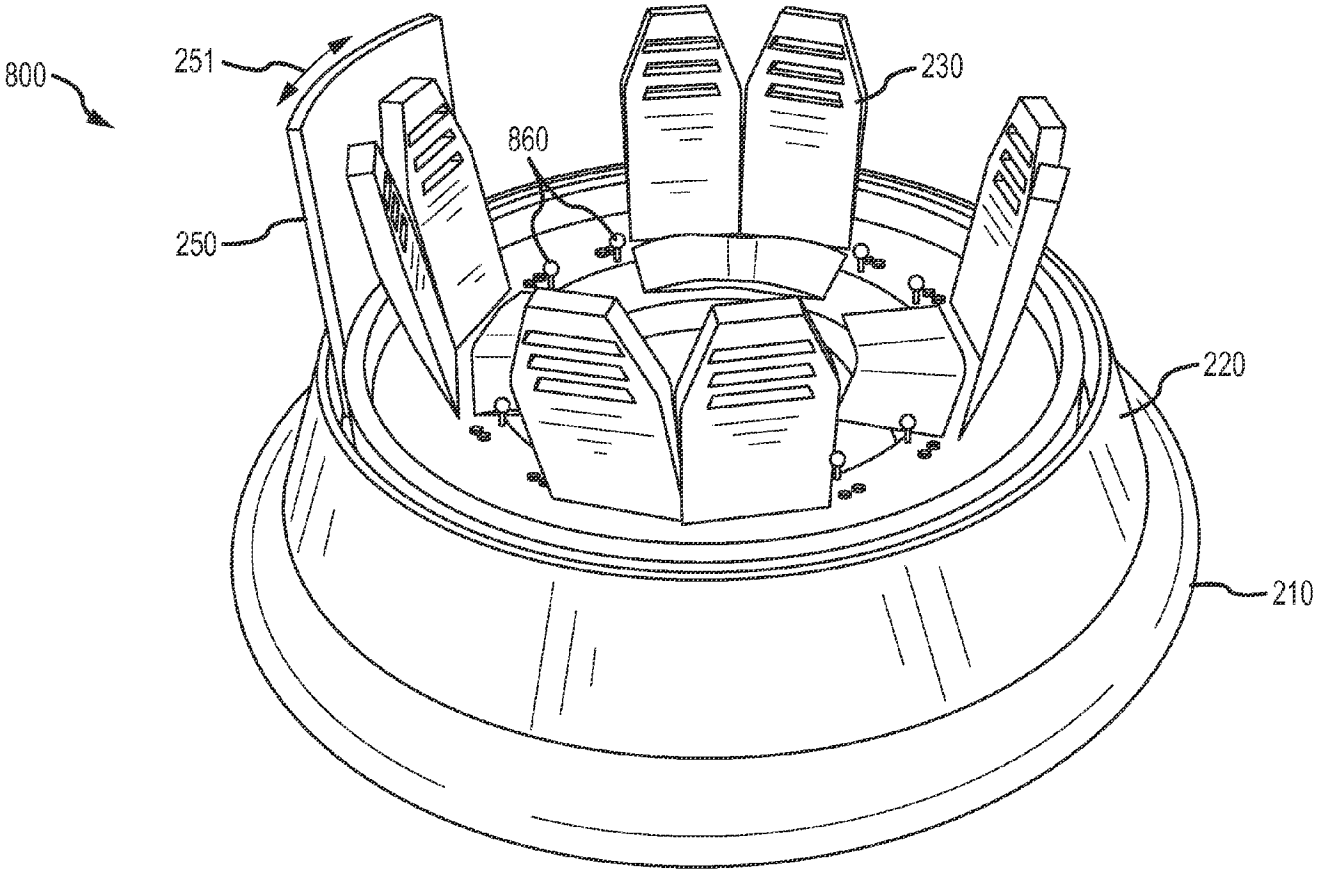
FIG. 8 is a top perspective view of a passenger boat similar to that shown in FIG. 2 but with a different implementation of a passenger or rider interactive device for use in selectively moving or positioning a water shield or barrier about the perimeter of the boat's hull.

FIG. 8 is a top perspective view of a passenger boat 800 similar to that shown in FIG. 2 but with a different implementation of a passenger or rider interactive device 860 for use in selectively moving or positioning 251 a water shield or barrier 250 about the perimeter of the boat's hull 220. Particularly, instead of a mechanical interactive device as shown in the boats 200, 300, and 600, the boat 800 may utilize interactive devices 860 in its passenger interactive assembly that use electronics to operate an actuation system. For example, the interactive device 860 may be configured to receive passenger input, e.g., pressing a button, sliding a knob, moving a joystick, or the like, and, in response, to make an electrical connection with an actuator that moves 251 the shield 250 in a track 240 on or in the hull 220.

The interactive devices 860 may take many forms to implement the boat 800 such as buttons, joysticks, or other user input devices. The user input portions typically are provided with a number that matches the number of passenger seats 230 and are located adjacent or nearby to each seat 230 for easy manipulation by passengers in these seats 230, though in some cases there may be fewer interactive devices 860 than seats 230 or even one interactive device 860 on the boat 800. The input portion 860 of the interactive assembly may be adapted for specifying direction of shield motion 251 (e.g., clockwise (CW) or counterclockwise (CCW)) within the track or channel guide 240, and, in some cases, the input devices may also be used to specify a speed of the movement 251 when the actuation system is configured to move the shield 250 at two or more rates (e.g., a variable speed electric motor may be provided in the actuation system that may be operated by a controller based on processing of signals from a user input device 860 in the passenger interactive assembly).

Figure 9:
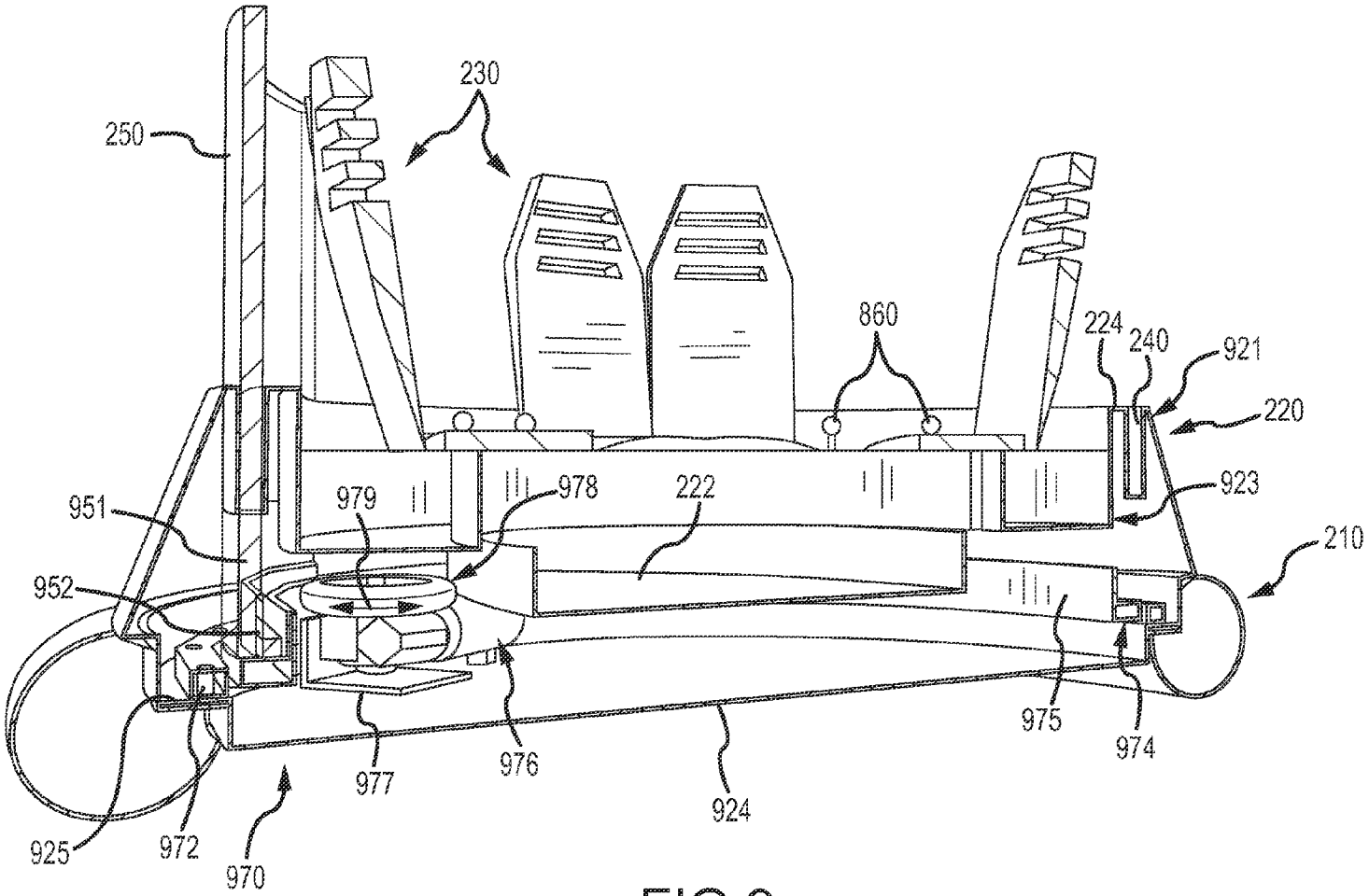
FIG. 9 is a side sectional view of the passenger boat of FIG. 8 illustrating another useful actuation system for use with the rider interactive assembly of this implementation of the passenger boat.
Figure 10:
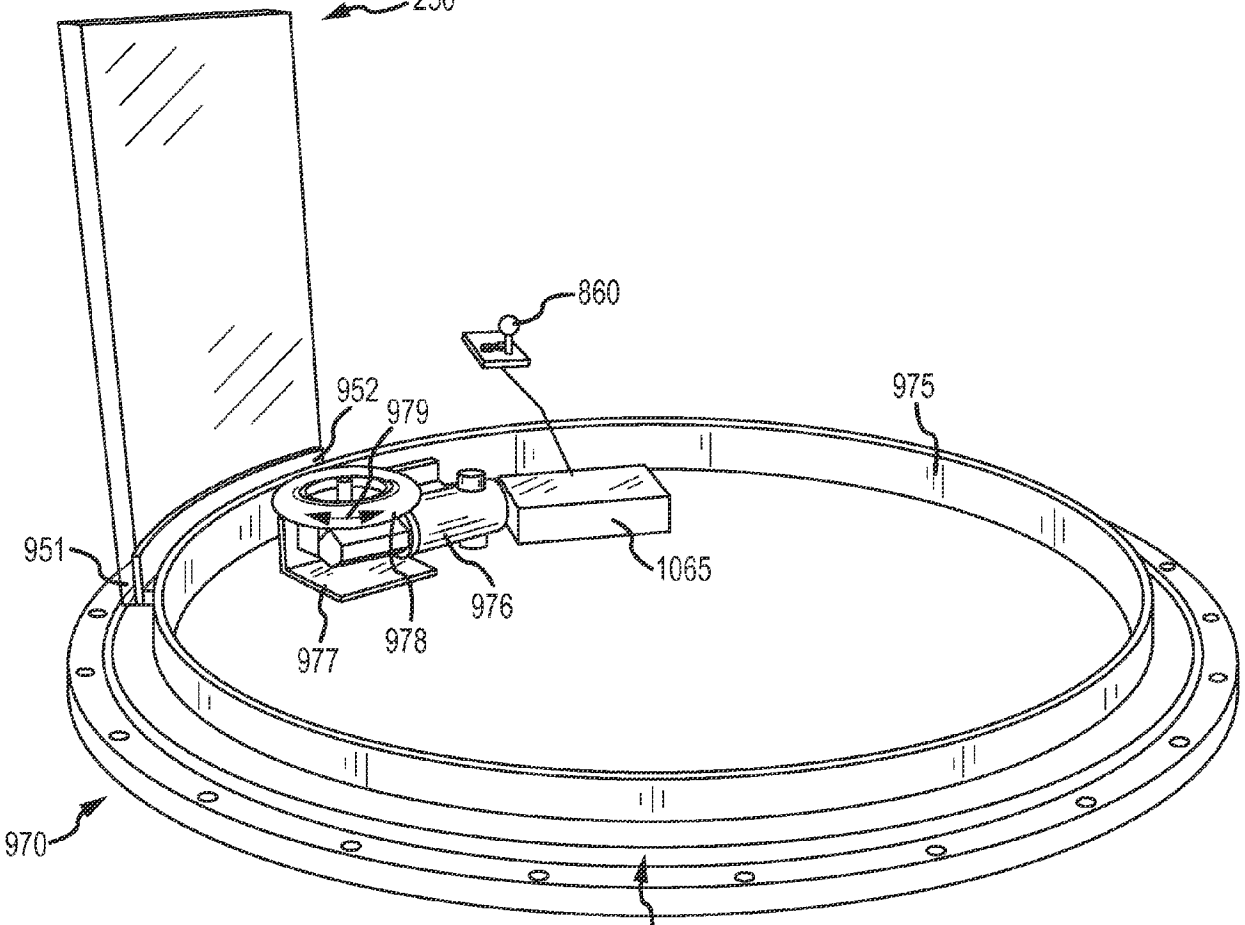
FIG. 10 is an exploded view of the passenger boat of FIGS. 8 and 9 with the hull, seats, and flotation components removed.

Now referring to FIGS. 9 and 10, the passenger boat 800 can be seen to include an interactive assembly made up of a plurality of interactive or user input devices 860 in the form of joysticks that send signals (in a wired or wireless manner) to a controller 1065. The controller 1065 may be a computer that is battery powered and with memory (computer readable medium) storing code for processing the user input signals from interactive devices 860 and, in response, to transmit (in a wired or wireless manner) control signals to an actuation system 970 to move the shield 250.

The passenger boat 800 has a hull 220 with an outer hull 921 and an inner hull 923 defining or supporting a shield guide channel or track 240 with an opening on an upper or top surface or side 224 of the hull 220. The hull 220 includes a deck 222 (upon which passengers may stand) and supports the passenger seats 230. Beneath the deck 222, the hull 220 includes a lower base plate 924 that is spaced apart from the deck 222 to define a space or void therebetween for containing the components of the actuation system 970 and, optionally, the controller 1065 (which could also be housed within the hull 220 at a different location such as beneath the seats 230).

In the passenger boat 800, the actuation system 970 includes an outer slewing ring 972 fixed to the hull 220 on support or receiving surface or ledge 925 and also an inner slewing ring 974 abutting and supported by the outer slewing ring 972 so as to be able to rotate about the center axis of the boat hull 220. The shield 250 is supported on the inner slewing ring 974 at its lower end 951 via shield bracket 952 (which is mounted to the inner slewing ring 974). The inner slewing ring 974 includes an extension that provides a friction wheel running surface 975.

The actuation system 970 includes a friction wheel 978 that is pivotally mounted via pedestal or mounting element 977 to the lower base plate 924 of the hull 220 (note, in some cases, the friction wheel 978 may be attached directly to a motor gearbox that can then be mounted to mounting element 977). An outer surface of the friction wheel 978 is placed in abutting or mating contact with the running surface 974 such that rotation 979 of the friction wheel 978 causes the inner slewing ring 974 to move, e.g., about the center axis of the boat 800 or hull 220. To drive this rotation 979, the actuation system 970 includes an electric motor 976 that is selectively operated to rotate the wheel 978 in one or two directions (CW and/or CCW) and at one or more rates by signals from the controller 1065 (which sends signals in response to processing of signals from rider interactive devices 860). In this manner, rider or passenger input can be translated into movement of the shield 250 in the channel (or on the track) 240 to move the shield about the perimeter of the boat 800 (or its hull 220) so as to allow the passengers to block or shield themselves from incoming streams or jets of water. There typically will be batteries provided on board the boat 800 to drive the motor 976, and a charging system may also be provided that allows the batteries to be recharged from an offboard electrical source.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

The passenger boat with the interactive water shield allows for a new category of interactive experiences on water rides as the riders are given defensive interactivity. The passenger boats allow for tailoring of the water ride experience to accommodate rider preferences as riders that want to get wet can by moving the shield away from their seats while concurrently allowing other riders that do not want to get wet to better avoid water spray by always shielding their seats. Water rides that include the new passenger boats will be fun and challenging since riders have to plan or account for spin and other movement of their boat in the water relative to water sources and have to shield the boat in the right place and at the right time (e.g., time movement of the roof or horizontal portion of the shield to cover the portion of the boat that will soon pass under a waterfall or the like). The experience, therefore, will be different each time with differing spin or boat movement and different riders to work with (or against) to move the water shield. This may promote more repeat rides and encourage social interactivity of the riders as they need to work as a team.

I claim:

1. A passenger boat for interactively shielding passengers from incoming water, comprising:

a hull with seats for receiving passengers;

a rider interactive assembly with an input element for receiving input from the passengers;

a water shield supported on the hull; and an actuation system operating in response to the input from the passengers to move the water shield from a first position to a second position relative to the seats, wherein the rider interactive assembly comprises a support arm linked to the input element to rotate about an axis in response to movement of the input element and wherein the actuation system responds to rotation of the support arm to move the water shield between the first and second positions.

2. The boat of claim 1, wherein the water shield is mounted on the hull to travel within a channel extending about a perimeter of the hull located on an outboard side of the seats.

3. The boat of claim 2, wherein the water shield comprises a wall that extends substantially vertically from the channel.

4. The boat of claim 2, wherein the water shield further comprises a roof element extending outward from an upper end of the wall toward a center axis of the hull.

5. The boat of claim 2, wherein the wall comprises at least one gap through which water may pass.

6. The boat of claim 1, wherein the actuation system comprises a connecting arm rigidly coupled at a first end to the support arm and at a second end to a slewing ring configured for rotating about a center axis of the hull and wherein the shield is supported upon the slewing ring to move with the slewing ring.

7. The boat of claim 1, wherein the actuation system comprises a connecting drive belt or chain mating with an outer surface of the support arm to move with the rotation of the support arm and further mating with a drive shaft of a friction wheel such that the friction wheel rotates with movement of the drive belt or chain and wherein the actuation system further comprises a slewing ring supporting the water shield and having a running surface mating with the friction wheel, whereby the slewing ring rotates about a center axis of the hull in response to rotation of the friction wheel.

8. A passenger boat for interactively shielding passengers from incoming water, comprising:

a hull with seats for receiving passengers;

a rider interactive assembly with an input element for receiving input from the passengers;

a water shield supported on the hull; and an actuation system operating in response to the input from the passengers to move the water shield from a first position to a second position relative to the seats, wherein the input element transmits electrical signals in response to the received input, wherein the rider interactive assembly further comprises a controller processing the electrical signals from the input element and in response transmitting shield movement control signals, and wherein the actuation system comprises an electric motor and batteries operating to drive movement of the shield from the first position to the second position in response to the shield movement control signals.

9. The boat of claim 8, wherein the electrical signals from the input elements are processed by the controller to determine both a direction of movement of the shield on the hull and a rate of the movement of the shield by the electric motor.

10. A vehicle for floating on water, comprising:
a circular sidewall enclosing a passenger space;
a water barrier extending a height above an upper surface of the sidewall;
a rotatable ring member supporting the water barrier; and
a passenger interactive assembly including a user input element for receiving input from passengers in the passenger space,
wherein the rotatable ring member rotates about an axis passing through the passenger space in response to the input received by the user input element.

11. The vehicle of claim 10, wherein the user input element is mechanically linked to the rotatable ring member.

12. The vehicle of claim 10, wherein the user input element is electronically linked to a drive motor operable to rotate the rotatable ring member.

13. A passenger boat for use in a water ride, comprising:
a hull with an outer sidewall;
a circularly-shaped guide channel extending along an upper surface of the outer sidewall;
a shield positionable along the length of the guide channel and extending outward a distance from the upper surface of the outer sidewall;
at least one interactive device for receiving input from one, two, or more passengers of the passenger boat; and
an actuation system operating in response to the input from the passengers to rotate the shield about a center axis of the hull in the guide channel,
wherein the shield comprises a wall that extends substantially vertically from the channel.

14. The boat of claim 13, wherein the actuation system comprises a connecting arm rigidly coupled at a first end to the interactive device and at a second end to a slewing ring configured for rotating about a center axis of the hull and wherein the shield is supported upon the slewing ring to move with the slewing ring.

15. The boat of claim 13, wherein the actuation system comprises a connecting drive belt or chain mating with a portion of the interactive device to move with the portion of the interactive device and further mating with a drive shaft of a friction wheel such that the friction wheel rotates with movement of the drive belt or chain and wherein the actuation system further comprises a slewing ring supporting the water shield and having a running surface mating with the friction wheel, whereby the slewing ring rotates about a center axis of the hull in response to rotation of the friction wheel.

16. The boat of claim 13, wherein the interactive device includes an input element that transmits electrical signals in response to the input, wherein the interactive device further comprises a controller processing the electrical signals from the input element and in response transmitting shield movement control signals, and wherein the actuation system comprises an electric motor and one or more batteries operating to drive movement of the shield from the first position to the second position in response to the shield movement control signals.

17. The boat of claim 16, wherein the electrical signals from the input elements are processed by the controller to determine both a direction of movement of the shield on the hull and a rate of the movement of the shield by the electric motor.

18. The boat of claim 13, wherein
the shield further comprises a roof element extending a distance from an upper end of the wall toward a center axis of the hull.

19. The boat of claim 8, wherein the water shield is mounted on the hull to travel within a channel extending about a perimeter of the hull located on an outboard side of the seats.

20. The boat of claim 19, wherein the water shield comprises a wall that extends substantially vertically from the channel.

21. The boat of claim 19, wherein the water shield further comprises a roof element extending outward from an upper end of the wall toward a center axis of the hull.

22. The boat of claim 19, wherein the wall comprises at least one gap through which water may pass.

23. A passenger boat for use in a water ride, comprising:
a hull with an outer sidewall;
a circularly-shaped guide channel extending along an upper surface of the outer sidewall;
a shield positionable along the length of the guide channel and extending outward a distance from the upper surface of the outer sidewall;
at least one interactive device for receiving input from one, two, or more passengers of the passenger boat; and
an actuation system operating in response to the input from the passengers to rotate the shield about a center axis of the hull in the guide channel,
wherein the actuation system comprises a connecting arm rigidly coupled at a first end to the interactive device and at a second end to a slewing ring configured for rotating about a center axis of the hull and
wherein the shield is supported upon the slewing ring to move with the slewing ring.

24. A passenger boat for use in a water ride, comprising:
a hull with an outer sidewall;
a circularly-shaped guide channel extending along an upper surface of the outer sidewall;
a shield positionable along the length of the guide channel and extending outward a distance from the upper surface of the outer sidewall;
at least one interactive device for receiving input from one, two, or more passengers of the passenger boat; and
an actuation system operating in response to the input from the passengers to rotate the shield about a center axis of the hull in the guide channel,
wherein the actuation system comprises a connecting drive belt or chain mating with a portion of the interactive device to move with the portion of the interactive device and further mating with a drive shaft of a friction wheel such that the friction wheel rotates with movement of the drive belt or chain, and
wherein the actuation system further comprises a slewing ring supporting the water shield and having a running surface mating with the friction wheel, whereby the slewing ring rotates about a center axis of the hull in response to rotation of the friction wheel.

25. A passenger boat for use in a water ride, comprising:
a hull with an outer sidewall;
a circularly-shaped guide channel extending along an upper surface of the outer sidewall;
a shield positionable along the length of the guide channel and extending outward a distance from the upper surface of the outer sidewall;
at least one interactive device for receiving input from one, two, or more passengers of the passenger boat; and
an actuation system operating in response to the input from the passengers to rotate the shield about a center axis of the hull in the guide channel,
wherein the interactive device includes an input element that transmits electrical signals in response to the input, wherein the interactive device further comprises a controller processing the electrical signals from the input element and in response transmitting shield movement control signals, and wherein the actuation system comprises an electric motor and one or more batteries operating to drive movement of the shield from the first position to the second position in response to the shield movement control signals.

26. The passenger boat of claim 25, wherein the electrical signals from the input elements are processed by the controller to determine both a direction of movement of the shield on the hull and a rate of the movement of the shield by the electric motor.

* * * * *